United States Patent [19]

Kort

[11] 4,264,313

[45] Apr. 28, 1981

[54] FLOATABLE DEVICES FOR AQUATIC SPORTS

[76] Inventor: Peter Kort, 5559 Neumagen-Dhron, Fed. Rep. of Germany

[21] Appl. No.: 41,067

[22] Filed: May 21, 1979

[30] Foreign Application Priority Data

May 26, 1978 [DE] Fed. Rep. of Germany ..... 2823154

[51] Int. Cl.[3] ..... B63H 1/30

[52] U.S. Cl. ..... 440/17; 9/310 R; 440/21

[58] Field of Search ..... 9/310 R, 310 B, 310 D; 440/13, 17, 21

[56] References Cited

U.S. PATENT DOCUMENTS

| | | | |
|---|---|---|---|
| 619,714 | 2/1899 | Birkby | 440/13 |
| 715,882 | 12/1902 | Sheen | 440/17 X |
| 3,122,122 | 2/1964 | Jenkins | 115/21 X |
| 3,232,608 | 2/1966 | Vlacancich | 115/28 R X |
| 3,807,342 | 4/1974 | Tarner | 9/310 B X |
| 3,833,956 | 9/1974 | Meehan | 115/25 X |
| 3,952,353 | 4/1976 | Word | 115/25 X |

FOREIGN PATENT DOCUMENTS

| | | | |
|---|---|---|---|
| 846660 | 8/1952 | Fed. Rep. of Germany | 9/1.1 |
| 2526334 | 12/1976 | Fed. Rep. of Germany | 115/28 R |
| 2269450 | 11/1975 | France | 115/28 R |
| 18410 | of 1900 | United Kingdom | 115/28 R |

*Primary Examiner*—George E. A. Halvosa
*Attorney, Agent, or Firm*—Robert W. Beach; Ward Brown; Douglas E. Winters

[57] ABSTRACT

A rocking member is installed in a recess in a device floating on water by a pivot shaft extending approximately parallel to the surface of the water. Such rocking member has a bottom impelling surface displaceable upward and downward by swinging of the rocking member. A plurality of water-trapping wedge-shaped fins, extending approximately parallel to the pivot shaft and spaced apart longitudinally of the device, project downward from the rocking member impelling surface.

11 Claims, 4 Drawing Figures

FLOATABLE DEVICES FOR AQUATIC SPORTS

BACKGROUND OF THE INVENTION

1. Field of the Invention

The present invention relates to a floatable device for aquatic sports for supporting a person standing thereon.

2. Prior Art

Many user-supporting aquatic sports devices are known. However, each of such known devices requires special skill on the part of a user and, consequently, is utilized only by a limited circle of people. In addition, the frequently high production costs of such devices prevent their wide distribution and use.

SUMMARY OF THE INVENTION

It is an object of the present invention to provide a floatable device of the kind hereinabove referred to which is uncomplicated, may be produced economically, does not require any special skill for its use and offers great stimulation to the user.

The foregoing object can be accomplished by a floatable device for aquatic sports for supporting a user standing thereon, which device includes a rocking member mounted in a recess in the device and having an impelling surface facing the water for cooperating with the water, such impelling surface being displaceable upward and downward by swinging of the rocking member about the axis of a pivot shaft extending approximately parallel to the surface of the water.

The impelling surface of the rocking member advantageously has several spaced wedge-shaped fins extending approximately parallel to the pivot shaft and projecting slightly rearward, opposite the direction of intended travel.

In a preferred embodiment, the rocking member includes a standing area having grip-promoting means such as grooves.

The rocking member preferably is approximately triangular in longitudinal vertical cross-section, with the pivot shaft being journaled in the thin aft portion of the rocking member.

The floatable device preferably is constructed as an elongated board-like floating member diminishing in width toward its bow, and the rocking member advantageously is installed in the aft third thereof. The rocking member pivot shaft preferably extends transversely of the boardlike member.

The board-like member preferably has bottom and top marginal webs projecting, respectively, beyond its top and bottom surfaces at its longitudinal sides.

A handlebar projects above the board-like member, preferably at a location forward of the rocking member with reference to the intended direction of travel.

The board-like member and the rocking member advantageously are foamed plastics material.

DETAILED DESCRIPTION OF THE PREFERRED EMBODIMENT

Figure 1:
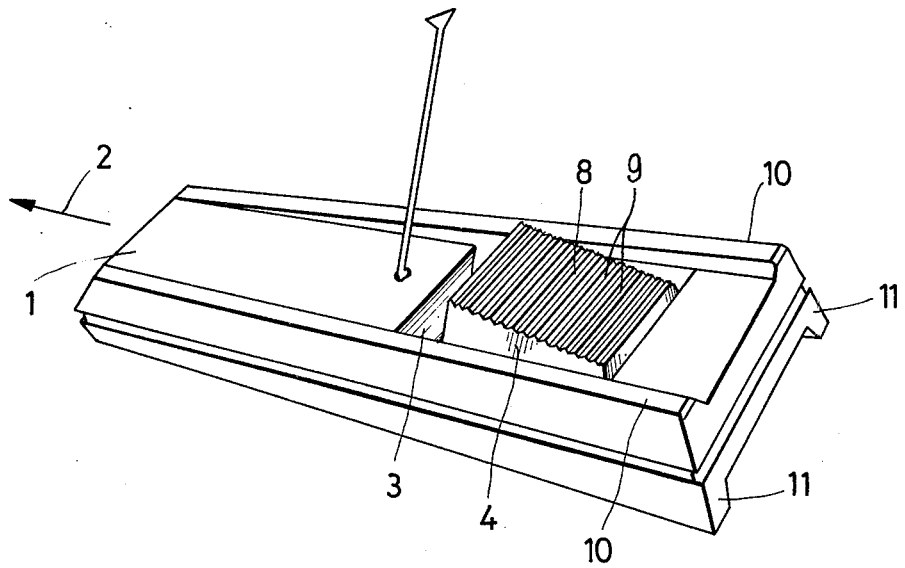
FIG. 1 is a top rear perspective view of a floatable device for aquatic sports in accordance with the present invention.
Figure 2:
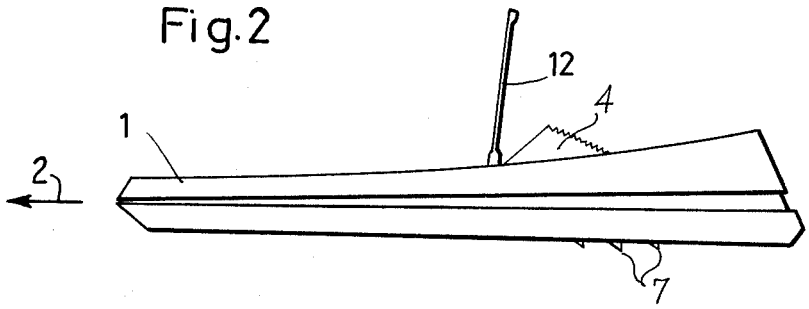
FIG. 2 is a side elevation of the device of FIG. 1.
Figure 3:
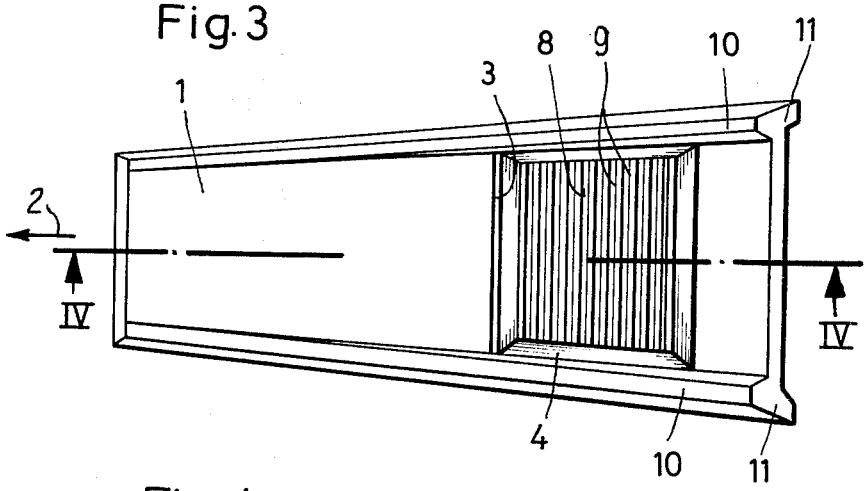
FIG. 3 is a top plan thereof.

Referring now to the drawings, as shown in FIGS. 1 and 3, the device of the present invention includes an elongated board-like floatable member 1 widening sternward with reference to the intended direction of travel indicated by the arrow 2. In its aft third, the board-like member 1 has a generally rectangular through vertical recess 3 wherein a rocking member 4 is mounted for swinging about the axis of a pivot shaft 5. Such shaft extends approximately parallel to the surface of water supporting the board-like member and transversely of such member.

Figure 4:
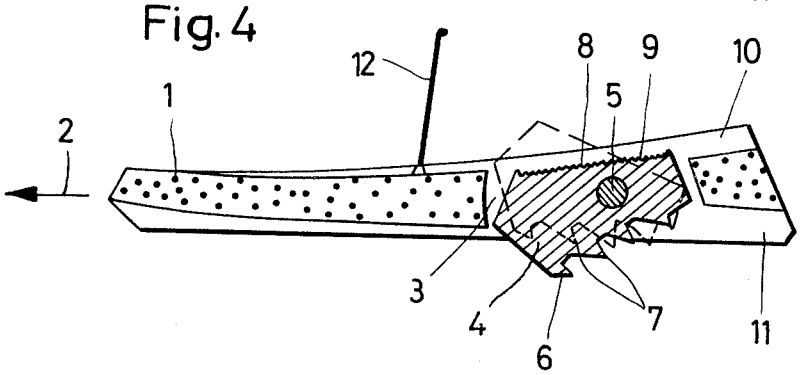
FIG. 4 is a section taken on line IV—IV of FIG. 3.

As shown in FIG. 4, the rocking member 4 is approximately triangular in longitudinal vertical section, such that the forward end of the rocking member is substantially thicker than the rear end of such member. The pivot shaft 5 is journaled in the thin rear or aft portion of the rocking member. The rocking member has a bottom impelling surface 6 facing the water. Water-trapping wedge-shaped fins 7, extending approximately parallel to the pivot shaft 5 and spaced apart longitudinally of the device, project angularly downward and aftward from the impelling surface.

The upper surface of the rocking member constitutes a standing surface 8 having grip-promoting means such as grooves 9.

At its longitudinal sides, the floatable board-like member 1 has upper marginal webs 10 and lower marginal webs 11 projecting, respectively, beyond the member top and bottom surfaces. Such webs are tapered outward from the board-like member 1. The upper marginal webs 10 decrease in height toward the bow of the board-like member and merge with the upper surface of such member approximately at its bow.

A handlebar 12 is mounted approximately at the center of the board-like member, forward of the rocking member.

In operation, a user positions himself or herself upright with one or both feet on the standing area 8 of the rocking member 4 and swings the rocking member back and forth like the treadle of a pedal scooter. Swinging of the rocking member 4 from the position shown in dashed lines in FIG. 4 to the position shown in solid lines, displaces the impelling surface 6 and its fins 7 downward into the water. Water trapped between the fins is forced rearward, moving the device forward in the direction of the arrow 2. The user may at the same time hold fast to the handlebar 12. Change in the direction of travel is accomplished by simple weight displacement. The device according to the invention may thus be utilized without special skill.

The board-like floatable member 1 and the rocking member 4 may be manufactured by an injection or casting process from foamed plastics material, such as polyurethane or the like, whereby the device has a very low weight with high portability and, furthermore, is economical to make. It is advantageous that the rocking member be sufficiently buoyant as to promote or even cause upward displacement of the impelling surface of the rocking member, so that the user need only swing the front of such member downward and release it, whereupon it will swing upward of its own accord.

I claim:

1. In a device for aquatic sports having a forward end and an aft end and including a floatable member for supporting a user thereon, a rocking member having an impelling surface for cooperating with water supporting the floatable member to effect forward movement of the device in the direction of its forward end and pivot means mounting the rocking member on the floatable member for reciprocatory swinging about an axis extending laterally of the floatable member, the improvement comprising the rocking member impelling surface being a continuous surface disposed forward of the pivot means axis toward the forward end of the device in the direction of forward movement of the device and being manually displaceable downward and rearward relative to the floatable member from an upper normal position to a depressed position by swinging of the rocking member, the rocking member being constructed and arranged so that the continuous impelling surface exerts a forward impelling force upon the floatable member to impel the floatable member in the forward direction by movement of the continuous impelling surface from its normal position to its depressed position by cooperation of the impelling surface with the water without exerting any substantial impelling force tending to impel the floatable member in any direction by movement of the continuous impelling surface from its depressed position to its normal postion, said rocking member being returned automatically to its upper normal position without exertion of manual force by the user supported on the device.

2. In the device defined in claim 1, the continuous impelling surface being rigid and having a plurality of fixed, spaced, water-trapping fins.

3. In the device defined in claim 2, the fins extending approximately parallel to the swinging axis of the rocking member.

4. In the device defined in claim 2, the fins projecting angularly downward and afterward.

5. In the device defined in claim 1, the rocking member being rigid and having an upper surface defining a standing area on which the user may stand when operating the device such that said rocking member standing surface remains stationary relative to the rocking member impelling surface.

6. In the device defined in claim 5, the floatable member having a generally vertical through recess receiving the rocking member such that the upright sides of said recess encircle the entire rocking member including its impelling surface and its standing surface when the rocking member is in its normal position.

7. In the device defined in claim 5, the standing area being disposed directly above the impelling surface.

8. In the device defined in claim 7, the standing area and the impelling surface converging rearward.

9. In a device for aquatic sports having a forward end and an aft end, such device including a floatable member for supporting a user thereon and a rocking member manually swingable relative to the floatable member and having an impelling surface for cooperating with water supporting the floatable member, the improvement comprising the impelling surface being displaceable downward and rearward relative to the floatable member by swinging of the rocking member from an upper normal position to a depressed position to exert a forward impelling force on the floatable member by cooperation of said impelling surface with the water, the rocking member being buoyant and the buoyancy of the rocking member resulting in exertion of force tending to return the rocking member from its depressed position to its upper normal position.

10. In the device defined in claim 9, pivot means mounting the rocking member on the floatable member for swinging about an axis extending laterally of the floatable member, at least a portion of the impelling surface being disposed between the pivot means axis and the forward end of the device.

11. In the device defined in claim 9, at least one of the members being foamed plastic material.

* * * * *